US012486679B2

(12) United States Patent
Maltais et al.

(10) Patent No.: US 12,486,679 B2
(45) Date of Patent: Dec. 2, 2025

(54) ADJUSTABLE MARGINAL WALL FOR FORM PANELS USED FOR CASTING CASTABLE MATERIAL AND METHOD OF CASTING CASTABLE MATERIAL

(71) Applicant: MSP STRUCTURES INC., Granby (CA)

(72) Inventors: Patrick Maltais, Granby (CA); Jasmin Sauvageau, Sherbrooke (CA)

(73) Assignee: MSP STRUCTURES INC., Granby (CA)

( * ) Notice: Subject to any disclaimer, the term of this patent is extended or adjusted under 35 U.S.C. 154(b) by 329 days.

(21) Appl. No.: 18/359,140

(22) Filed: Jul. 26, 2023

(65) Prior Publication Data

US 2024/0035292 A1 Feb. 1, 2024

Related U.S. Application Data

(60) Provisional application No. 63/392,178, filed on Jul. 26, 2022.

(51) Int. Cl.

| | |
|---|---|
| ***E04G 9/10*** | (2006.01) |
| ***E04G 9/02*** | (2006.01) |
| ***E04G 19/00*** | (2006.01) |

(52) U.S. Cl.

CPC ..... *E04G 9/10* (2013.01); *E04G 19/003* (2013.01); *E04G 2009/023* (2013.01)

(58) Field of Classification Search

CPC ... E04G 9/10; E04G 19/003; E04G 2009/023; E04G 11/065; E04G 11/085; E21D 11/102

See application file for complete search history.

(56) References Cited

U.S. PATENT DOCUMENTS

| | | | | |
|---|---|---|---|---|
| 1,751,147 A * | 3/1930 | Hackley | E21D 11/102 405/150.1 |
| 1,819,664 A * | 8/1931 | West | E21D 11/102 249/11 |
| 2020/0002957 A1* | 1/2020 | Mancini | E21D 11/102 |
| 2021/0148231 A1* | 5/2021 | Mancini | E21D 11/105 |

* cited by examiner

*Primary Examiner* — Gisele D Ford

(74) *Attorney, Agent, or Firm* — Jacob M. Ward; Ward Law Office LLC

(57) ABSTRACT

A form panel with a marginal wall for casting castable material, which has an edge to be positioned near an external surface and a fixed support for attachment to the form panel, fingers movably carried by the fixed support and movable relative to the edge of the form panel between an extracted and retracted position. The fingers extending beyond the edge of the form panel edge in their extracted position, the fingers having a load-bearing surface for retaining castable material slurry, and an actuation mechanism for moving the fingers between the positions. The fingers are movably carried by the fixed support such that at least some of the fingers are movable with respect to the others for forming a marginal barrier between the edge of the form panel and the external surface.

21 Claims, 17 Drawing Sheets

ADJUSTABLE MARGINAL WALL FOR FORM PANELS USED FOR CASTING CASTABLE MATERIAL AND METHOD OF CASTING CASTABLE MATERIAL

CROSS REFERENCE TO RELATED APPLICATIONS

The present application claims the priority of U.S. provisional application No. 63/392,178 filed on Jul. 26, 2022. The entire disclosure of the above application is hereby incorporated herein by reference.

FIELD

The present invention relates to form panels for pouring castable material such as concrete, and more particular to a marginal wall for a form panel used in pouring castable material.

BACKGROUND

Construction castable material refers to any material that may be cast, i.e. which may be poured as a slurry to then dry or cure to a hardened state. Concrete is the most frequently used construction castable material, used for example to build walls in tunnels and in many other applications.

The slurry has a certain viscosity but may flow, and consequently temporary barriers called form panels are assembled to create walls between which, or behind which, castable material slurry will be poured. The purpose of a form panel assembly is to allow the slurry to accumulate and be retained at the position of the form panel assembly, while it cures. Then, once the castable material is hard, the form panel assembly is removed.

Each form panel assembly typically comprises a wall formed of a number of form panels that are carried by a form panel support structure that rests on, and is secured to, the ground, a tunnel wall, or other stable surface. The form panels have a shape and geometry that depends on the desired shape and geometry of the concrete wall to be cast. For example, if a straight concrete wall is to be cast, then the form panels can be rectangular in shape and disposed side-by-side to form a continuous barrier. At their lower end, they are fitted on a support structure. Within a cylindrical tunnel, the form panels might instead be annular.

There exists a challenge to seal the space between an edge of the form panel assembly with respect to an external surface that the concrete wall is to be cast against. For instance, this external surface might be the ceiling or wall of a tunnel that has been excavated, where castable material walls need to be formed between the bottom of the tunnel and the ceiling. Since the tunnels are typically excavated through natural rock by drilling or blasting procedures, the rock ceiling or wall surface is uneven. Consequently, a marginal wall needs to be created between the edge of the form panels and the irregular rock ceiling or wall.

In the prior art, the marginal walls for use in bridging the space between form panels and the tunnel ceiling or wall are accomplished with wooden boards that are manually added to the form panel assembly one by one beyond the edges of the form panels, with nails or screws, and with proper bracing structures. This is very time consuming: depending on the size of the marginal wall portion that is required, it typically requires several workers to work many hours to accomplish this.

SUMMARY OF THE INVENTION

The invention relates to the combination of a form panel and a marginal wall for use in casting castable material, the form panel having an edge to be positioned near an external surface, the marginal wall comprising a fixed support for attachment to the form panel, a number of fingers movably carried by the fixed support so as to be movable relative to the edge of the form panel between an extracted and a retracted position, with the fingers extending beyond the edge of the form panel edge at least in their extracted position, the fingers having a load-bearing surface for retaining castable material slurry, and an actuation mechanism capable of moving the fingers between the retracted and extracted positions, wherein the fingers are movably carried by the fixe support such that at least some of the fingers are distinctly movable with respect to the others for forming a marginal barrier of variable size between the edge of the form panel and the external surface when the fingers are moved towards or into their extracted position.

In one embodiment, the fingers are slidably attached to a movable support that is movably carried by the fixed support, with the actuation mechanism moving the movable support relative to the fixed support, and with the fingers being carried by the movable support so as to allow the fingers to move concurrently with the movable support under the action of the actuation mechanism, and with the fingers additionally being slidable relative to the movable support if sufficient force is applied upon the fingers to overcome a resistance threshold for allowing the fingers to move distinctly with respect to each other and with respect to the movable support when at least some fingers abut the external surface.

In one embodiment, the edge of the form panel is straight and the fingers are disposed parallel to each other.

In another one embodiment, the edge of the form panel is curved and the fingers are each disposed generally perpendicularly to the curved edge in a divergent configuration.

In one embodiment, the combination further comprises a locking mechanism for releasably locking the position fingers of the fingers relative to the movable support.

In one embodiment, the actuation mechanism comprises selectively powered hydraulic cylinders attached to the fixed support and to the movable support.

In one embodiment, the actuation mechanism comprises at least one manually operable crank bolt attached to the fixed support and to the movable support.

In one embodiment, the actuation mechanism comprises additional fine displacement members to move the fingers relative to the movable support.

In one embodiment, when the form panel defines a load-bearing surface that is generally parallel to the load-bearing surface of the fingers, and when the fingers are moved from their extracted towards their retracted position, they also move transversely in a direction that is away from the form panel load-bearing surface.

The invention further relates to a marginal wall for use with a form panel used for casting castable material, comprising:

- a fixed support for attachment to the form panel;
- a number of fingers movably carried by the fixed support so as to be movable relative to the fixed support between an extracted and a retracted position, with the fingers for extending beyond an edge of the form panel edge at least in their extracted position, and with the fingers having a load-bearing surface for retaining castable material slurry;

an actuation mechanism capable of moving the fingers between the retracted and extracted positions;

wherein the fingers are movably carried by the fixed support such that at least some of the fingers are distinctly movable with respect to the others, for forming with the fingers a marginal barrier of variable size beyond the edge of the form panel.

The invention also relates to a method of casting castable material in a target area comprising the steps of:

providing a form panel;

providing a marginal wall comprising a fixed support, a number of fingers movably carried by the fixed support, and an actuation mechanism capable of moving the fingers relative to the fixed support;

attaching the fixed support of the marginal wall to the form panel;

placing the form panel at a limit position of the target area where the castable material is to be cast, with the form panel having an edge positioned near an external surface;

moving, with the actuation mechanism, at least some of the fingers beyond and away from the edge of the form panel to form a marginal barrier between the edge of the form panel and the external surface, with at least some of the fingers being moved distinctly from the others such that the marginal barrier will be of variable dimensions; and pouring castable material slurry in the target area and retaining the castable material slurry in the target area with the form panel and with a load-bearing surface of the fingers of the marginal wall, with the fingers of the marginal wall preventing the castable material slurry from flowing between the edge of the form panel and the external surface.

In one embodiment, the fingers are slidably attached to a movable support that is movably carried by the fixed support, with the step of moving at least some of the fingers beyond and away from the edge of the form panel comprising:

moving the movable support relative to the fixed support with the actuation mechanism; and allowing at least some fingers to abut the external surface wherein a sufficient force is applied upon the fingers to overcome a resistance threshold to move the fingers distinctly with respect to each other and with respect to the movable support.

In one embodiment, in the step of moving at least some of the fingers beyond and away from the edge of the form panel, the fingers are moved parallel to each other, such that the marginal barrier formed by the fingers is generally straight.

In an alternate embodiment, in the step of moving at least some of the fingers beyond and away from the edge of the form panel, the fingers are moved in a divergent configuration, such that the marginal barrier formed by the fingers is generally curved.

DETAILED DESCRIPTION OF THE EMBODIMENTS

Figure 1:
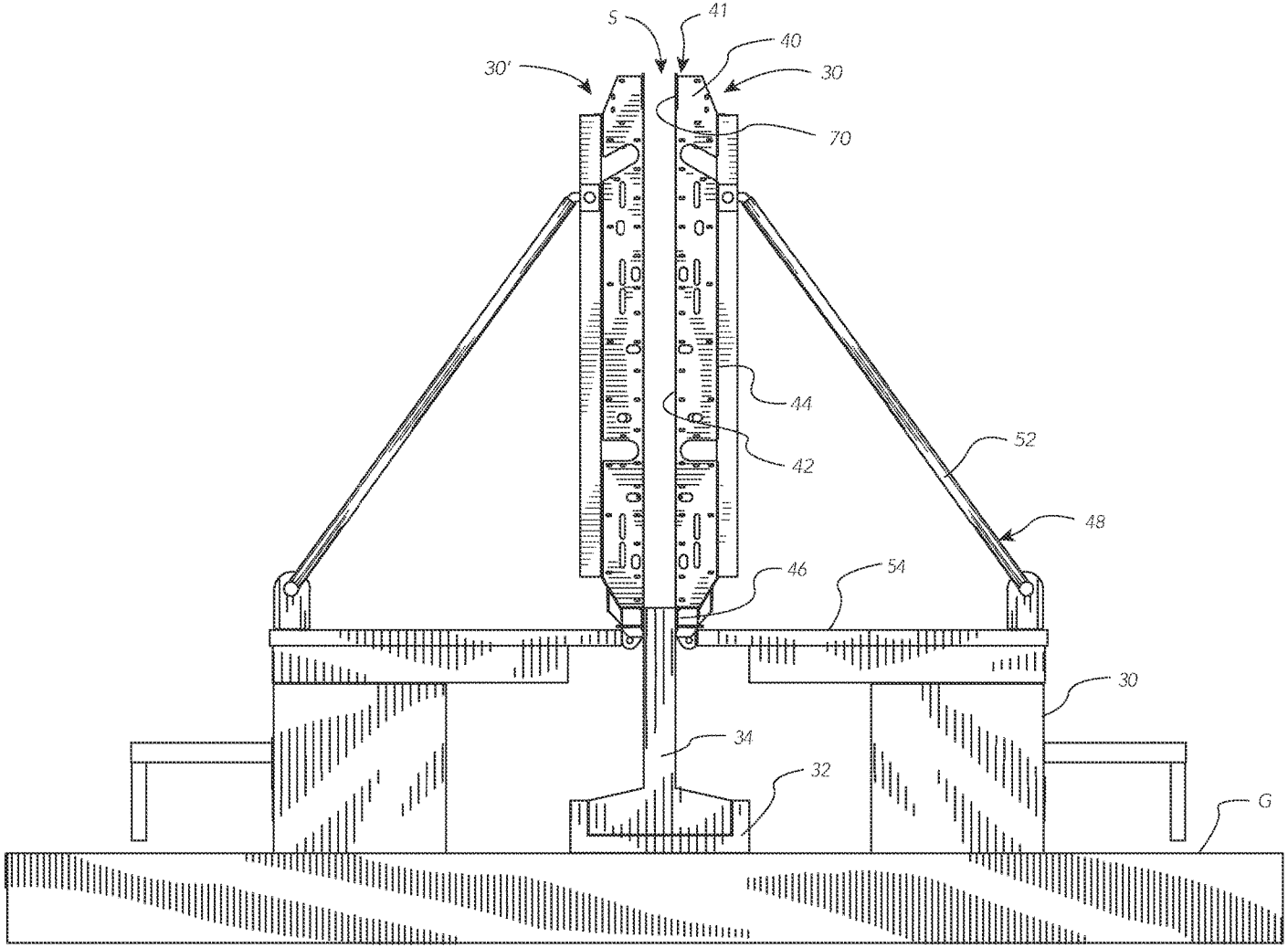
FIG. 1 is an end view of two form panel assemblies each equipped with a marginal wall assembly according to one embodiment of the invention, with the form panels being in facing register over ground for casting a straight wall of castable material therebetween, and further showing a concrete slab that rests on the ground over which the concrete wall is to be cast.

FIG. 1 shows a pair of face-to-face form panel assemblies 30, 30' for erecting a concrete wall (not shown) in the space S therebetween. A wall base 32 rests on the ground G and concrete slabs 34 are installed end-to-end on wall base 32. Castable material slurry will be poured, as is known in the art, between the pair of form panel assemblies 30, 30' over the concrete slabs 34 to fill space S until the concrete slurry reaches the ceiling (not shown in FIG. 1) which is typically an irregular, uneven rock surface. Then, the slurry will dry to form a concrete wall. Form panel assemblies 30, 30' are then removed. The castable material can be any suitable material that may be cast between form panel assemblies 30, 30' in fluid slurry state, to thereafter dry, such as concrete.

Figure 2:
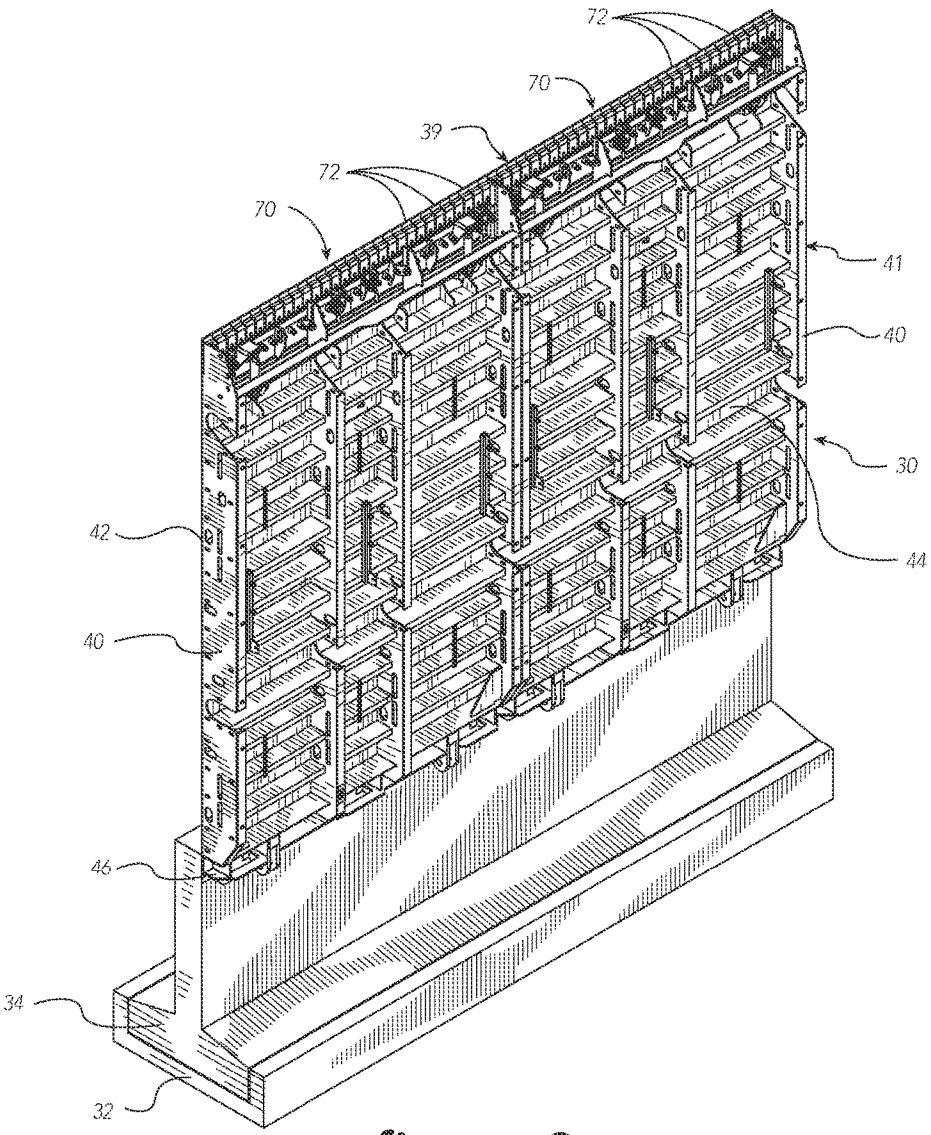
FIG. 2 is a perspective view of two form panels of one of the form panel assemblies of FIG. 1, together with the ground-resting concrete slab.

FIGS. 1 and 2 show that each form panel assembly 30, 30', for example form panel assembly 30, conventionally comprises a number of form panels 40 that are installed in end-to-end relationship to collectively form a barrier wall 41 for retaining the castable material slurry while it dries. Only two form panels 40 are shown in FIG. 2, but usually many form panels 40 will be installed in end-to-end relationship when long castable material walls are to be cast.

Each form panel 40 has a flat load-bearing surface 42 facing towards space S and an opposite exterior surface 44 facing away from space S. The castable material slurry poured in spaced S will rest against load-bearing surface 42 while it sets. Form panel 40 is positioned such that its bottom edge 46 is adjacent to the top edge of concrete slabs 34 to seal the bottom part of wall 41 relative to concrete slabs 34. A form panel support frame 48 (schematically shown in FIG. 1) rests on, and is secured to, the ground G and supports form panel 40. Form panel support frame 48 comprises miscellaneous structures known in the art, including but not limited to a ground-resting member 50, braces 52 and horizontal members 54. Form panel support frame 48 allows form panel 40 to be maintained in a vertical position despite the significant pressure incurred by the concrete slurry poured in spaced S.

Figure 3:
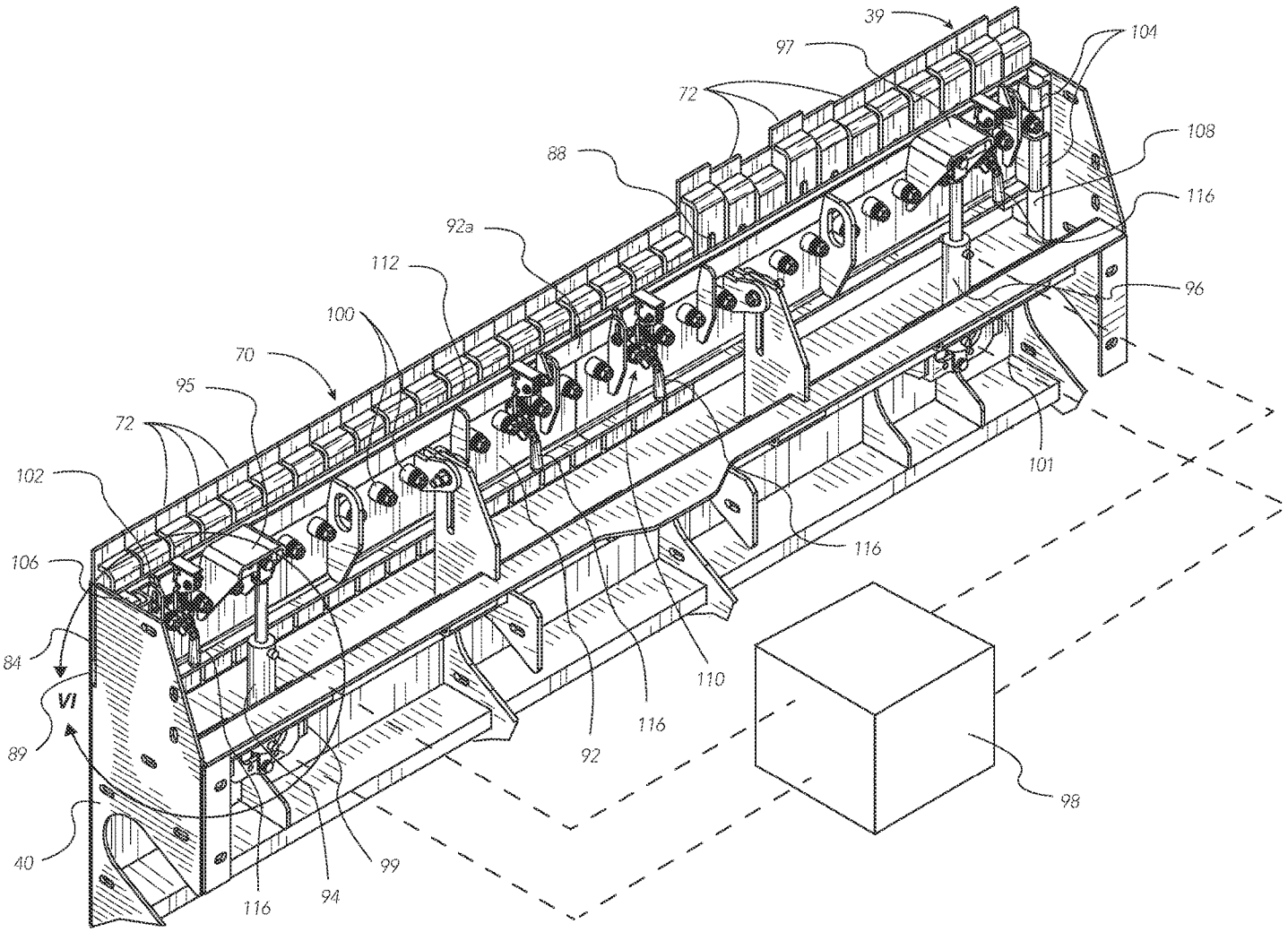
FIG. 3 is an enlarged perspective view of top portion of one form panel of FIG. 2 together with its marginal wall.
Figure 4B:
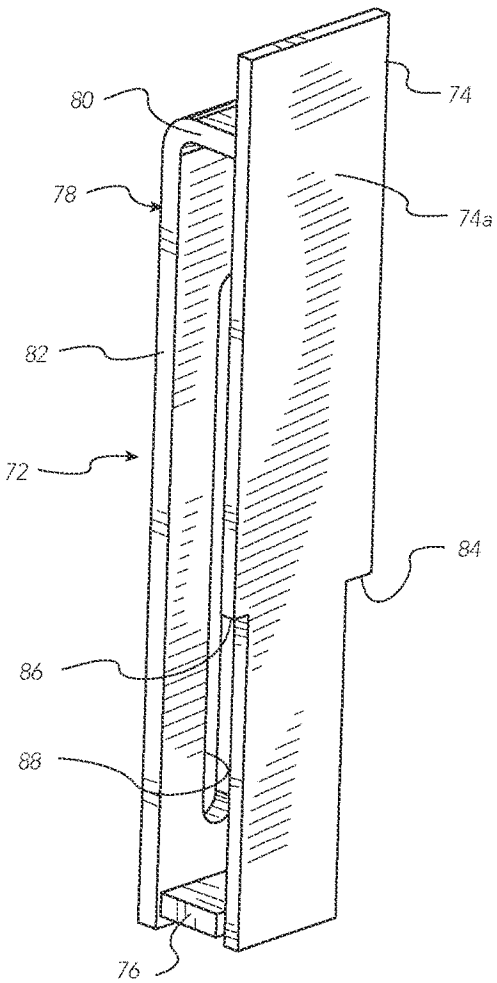
FIGS. 4A and 4B are enlarged perspective views respectively of the back and the front of one finger forming the marginal wall of FIG. 3.
Figure 4A:
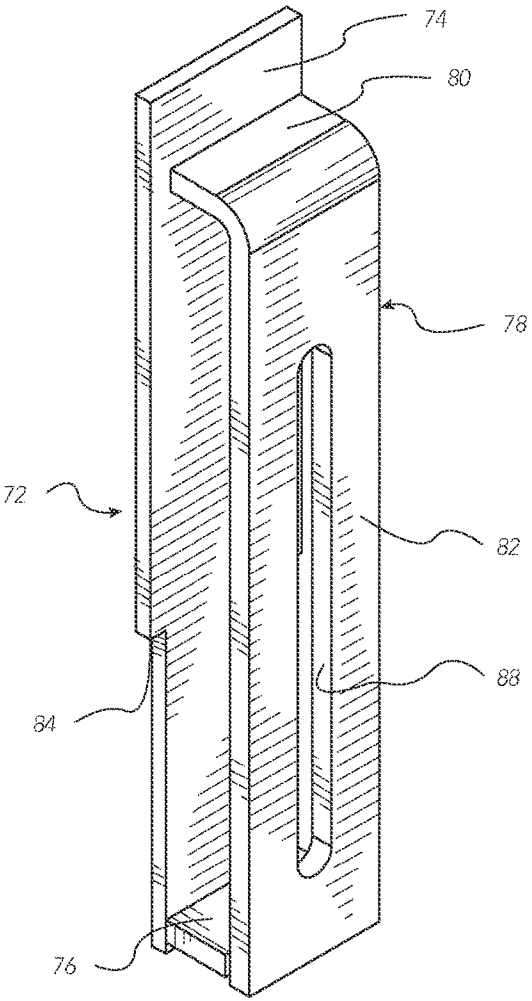

FIGS. 2 and 3 show that barrier wall 41 is equipped with a marginal wall assembly 39 that comprises marginal walls 70 each installed at the top end of a corresponding form panel 40 to seal the space between the top edge of form panel 40 and the irregular rock surface of the tunnel ceiling, as described hereinafter.

FIGS. 2, 3, 4A, 4B and 5-7 show that marginal wall 70 comprises a number of fingers 72 that are installed in adjacent, side-by-side relationship. Each finger 72 comprises a flat front wall 74 against the load-bearing front surface 74*a* of which concrete slurry will accumulate and bear against while it dries; and an L-shaped back wall 78 that has a first segment 80 attached to load-bearing wall 74 and a second segment 82 that depends from first segment 80 and that is parallel to, and spaced-apart from, front wall 74. A tongue 76 is fixed at the lower end of front wall 74, extending towards but just short of back wall back wall second segment 82. The side edges of fingers 72 are straight, and comprise shoulders 84, 86 that engage corresponding shoulders 85 of wall panel 40 in a retracted position of fingers 72, as detailed hereinafter. Back wall 78 comprises an elongated guide slot 88 that extends along vertical segment 82, the purpose of which will also be detailed hereinafter.

Marginal wall 70 further comprises a stringer 90 in the form of an elongated cross-sectionally rectangular block that extends along the entire width of marginal wall 70, and which is located over the top edge of form panel 40 when marginal wall 70 is mounted to wall panel 40. Fingers 72 snugly straddle stringer 90 with their respective front and back walls 74, 78 such that fingers 72 may slide up and down relative to stringer 90.

Marginal wall 70 also comprises a movable support 92 in the form of an elongated, generally flat plate that that extends along the entire width of marginal wall 70, an which is also located over the top edge of form panel 40 when marginal wall 70 is mounted to wall panel 40. Movable support 92 is positioned in facing register with, and behind, stringer 90. Movable support 92 is carried by a pair of hydraulic cylinders 94, 96 that are fixed at a first end to movable support 92 with first brackets 95, 97. Hydraulic cylinders 94, 96 are fixed at their other end to form panel 40 with a fixed support in the form of second brackets 99, 101 such that when hydraulic cylinders 94, 96 are activated by a selectively powered hydraulic actuation mechanism 98, movable support 92 will move vertically relative to form panel 40. Actuation mechanism 98 includes all necessary components known in the art such as a motor, fluid pumps, tubing, valves, etc. . . . to control the retraction and extraction of hydraulic cylinders 94, 96.

Any other suitable lifting mechanism could be used instead of hydraulic cylinders 94, 96.

Marginal wall 70 is fixed to form panel 40 near its top edge with second brackets 99, 101 that are more particularly fixed to form panel 40 with a suitable fixation, e.g., bolts, welding, etc. . . . , such that the top of fingers will initially protrude slightly above the top edge of form panel 40. Marginal wall 70 is further guided and maintained in position with C-shaped guide plates 102, 104 that are fixed to movable support 92 and that engage in sliding relationship corresponding vertical guide bars 106, 108 that are fixed to form panel 40. C-shaped guide plates 102, 104 can vertically slide along guide bars 106, 108 to allow vertical displacement of movable support 92 relative to form panel 40, as detailed below.

A number of bolts 100 are provided on marginal wall 70, each used to attach a corresponding finger 72 to movable support 92 and to stringer 90. More particularly, each bolt 100 engages and extends through a hole made through movable support 92, through elongated slot 88 of the back wall 78 of its corresponding finger 72 and is threaded into a threaded bore in stringer 90.

The back wall 78 of finger 72 is sandwiched between movable support 92 and stringer 90. Back wall 78 is allowed some slight flexing movement relative to front wall 74 due to its intrinsic resiliency. Tongue 76 prevents it from bending too far in the direction of front wall 74. Bolts 100 have a tension spring 103 that allows to adjustably tighten fingers 72 against movable support 92, with back wall 78 yielding slightly to accommodate this tension adjustment. The more bolt 100 is tightened, the more the friction between i.) the finger back wall 78, and ii.) movable support 92 and stringer 90 will be increased. A desired level of friction may consequently be achieved with bolts 100, as detailed hereinafter, which will both allow fingers 72 to be carried by movable support 92 while allowing fingers 72 to slide up and down relative to movable support 92 and stringer 90 if sufficient force is exerted on fingers 92 to overcome a resistance threshold defined by the friction force between finger 72 and movable support 92/stringer 90. If the friction force is overcome, fingers 72 may then move distinctly with respect to each other and with respect to movable support 92/stringer 90.

Figure 5:
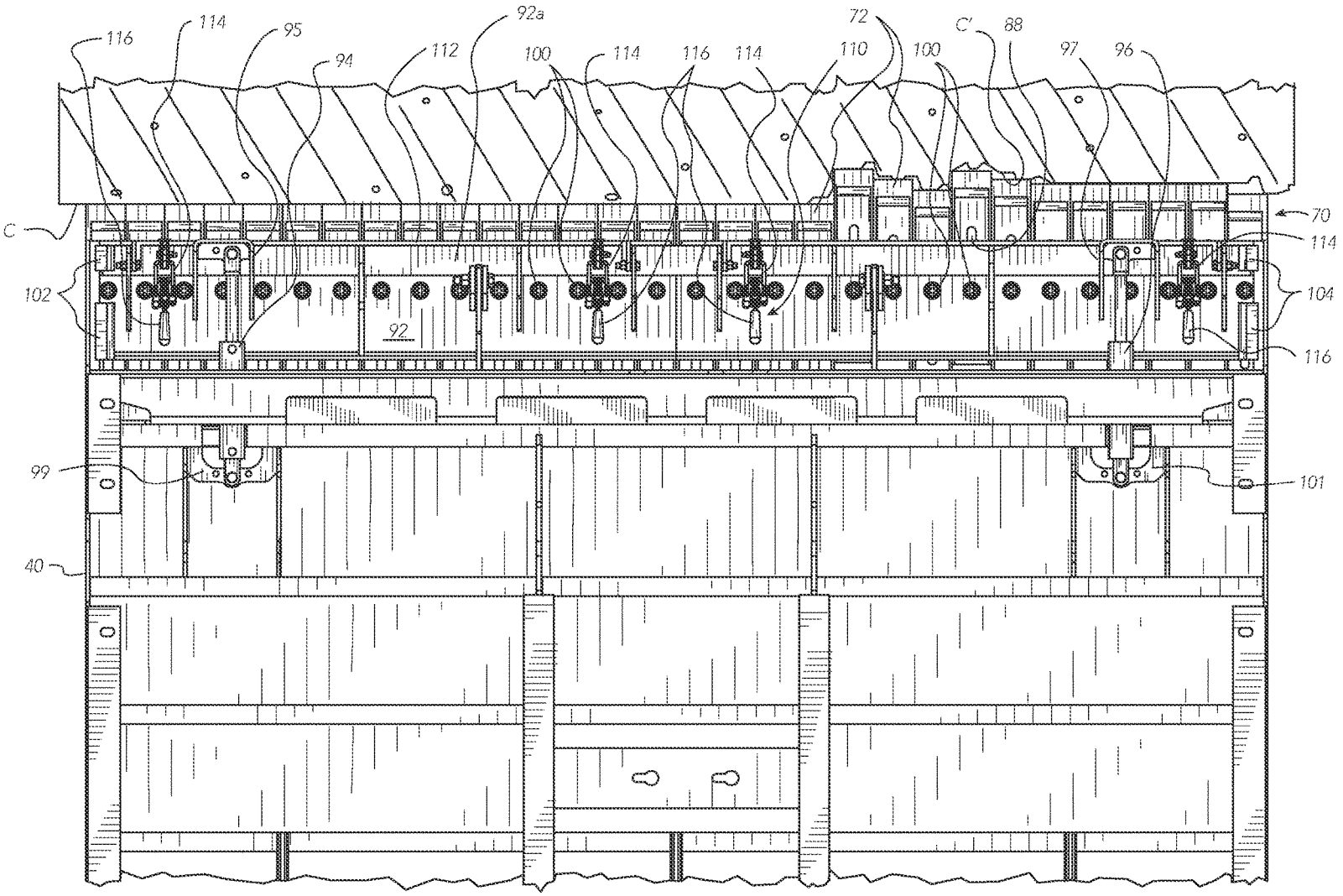
FIG. 5 is an enlarged perspective view of the top portion of one form panel of FIG. 2 together with its marginal wall, further showing the ceiling of a tunnel, with the marginal wall bridging the space between the form panel and the tunnel ceiling.
Figure 6:
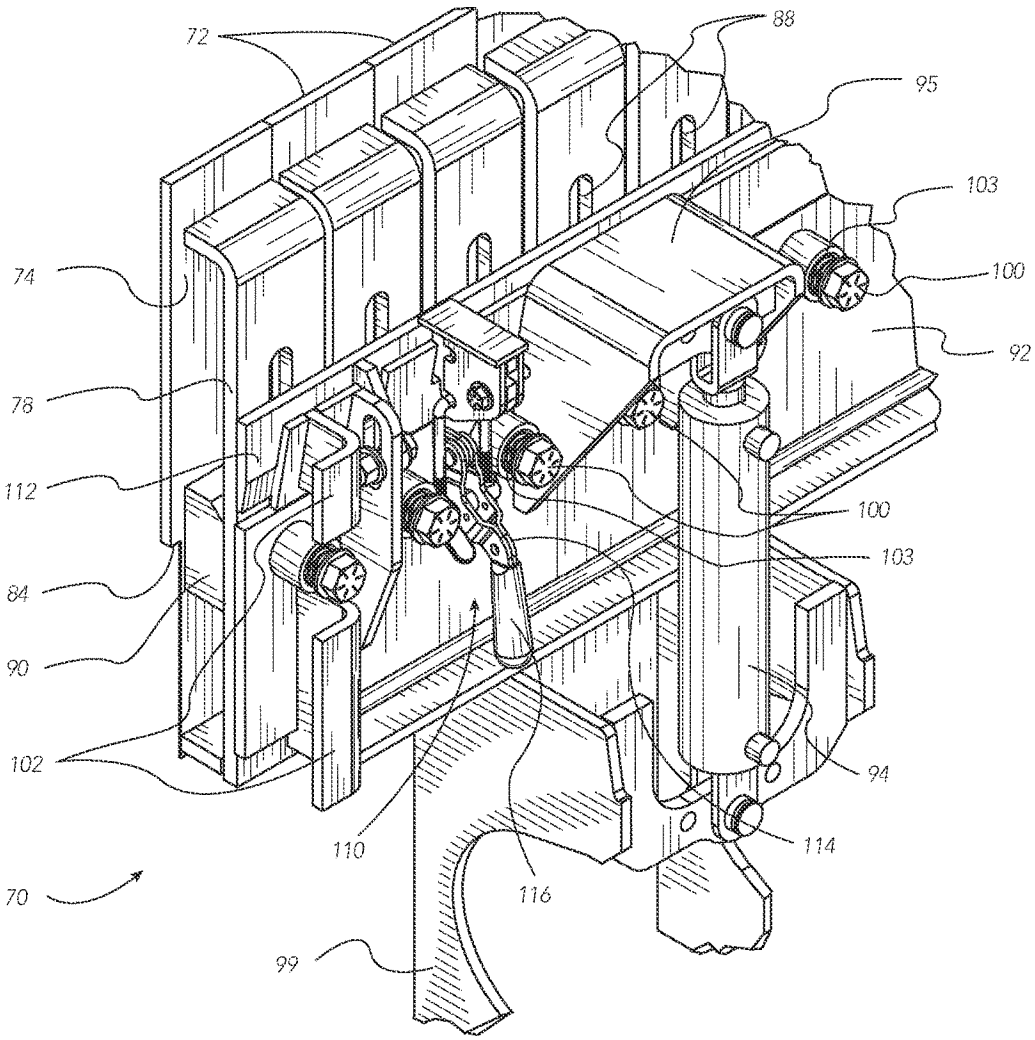
FIG. 6 is an enlarged perspective view of the area circumscribed by circle VI in FIG. 3, with the locking mechanism being in unlocked state.
Figure 7:
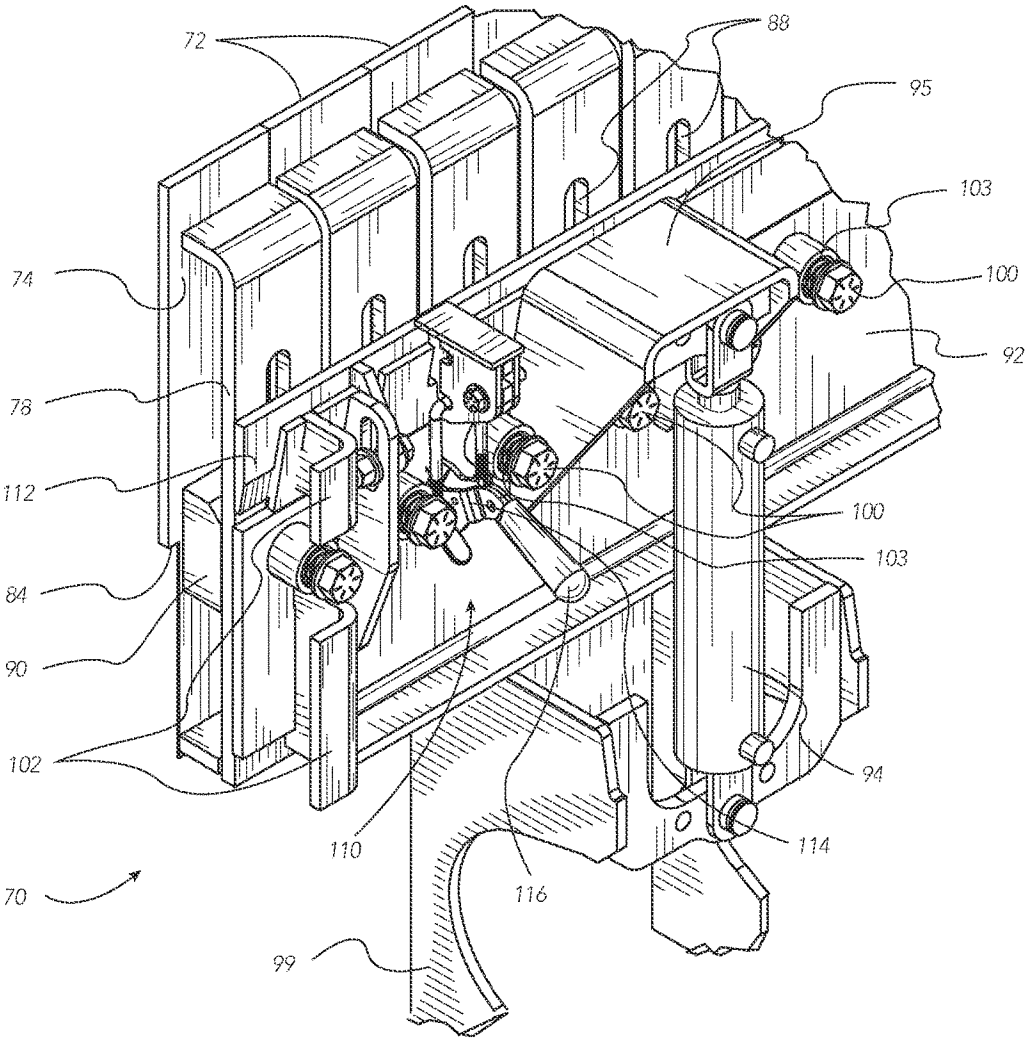
FIG. 7 is similar to FIG. 6, but with the locking mechanism being in locked state.

In use, form panels 40 equipped with marginal walls 70 are installed at the desired location where castable material slurry is to be poured. Before the concrete slurry is poured, actuation mechanism 98 is activated to raise the movable support 92 of marginal wall 70. This will in turn raise all fingers 72 towards the ceiling C of the tunnel, shown in FIG. 5, which ceiling may have an irregular surface as shown in FIG. 5. Movable support 92 will be allowed to move further towards the ceiling C once some fingers 72 contact the ceiling C, as the tension of bolts 100 is adjusted to allow the fingers 72 to slide relative to movable support 92 as mentioned above. This will allow some fingers 72 to abut against the ceiling C earlier than others, such that other fingers 72 will continue to be raised into concavities such as concavity C' in the ceiling.

The tension in bolts 100 is consequently adjusted to achieve a level of friction between fingers 72 and movable support 92, which at least prevent fingers 72 to fall under their own weight and to move under parasite friction from neighboring fingers 72 that might move independently; while otherwise allowing fingers 72 to slide relative to movable support 92 and stringer 90 when they abut an immovable external surface such as ceiling C.

The fingers 72 of marginal wall 70 consequently allow to create a marginal barrier of variable dimensions between the top edge of form panel 40 and the ceiling C. This allows to accommodate irregular rock formations and also facilitates installation of the form wall assembly 30 that may be loosely fitted relative to the ceiling—or any other surface against which the concrete is to be poured—since extracting the fingers 72 will compensate the space left between the form panel 40 and the ceiling C or other external surface.

It is noted that although reference to a tunnel ceiling is made hereinabove, the external surface could be a wall, floor, natural or constructed, or any other suitable fixed external surface A releasable locking mechanism 110 is optionally provided on marginal wall 70. Locking mechanism 110 comprises a wedge plate 112 that slides between an inclined segment 92*a* of movable support 92 that is inclined away from the back walls 78 of fingers 72. Wedge plate 112 is connected to a toggle mechanism 114 that is attached to the back side of movable support 92 of marginal wall 70. When a handle 116 of toggle mechanism 114 is pivoted between a lowered position shown in FIGS. 2, 3, 5 and 7 and a raised position shown in FIG. 6, wedge plate 112 will be correspondingly moved from:

i) an unlocked position (FIGS. 2, 3, 5 and 6) wherein it is released from, i.e., spacedly located above, the intersection of support wall inclined segment 92*a* and finger back wall 78. In this position, wedge plate does not hinder the movement of fingers 72 relative to movable support 92 and stringer 90; and ii) a locking position (FIG. 7), wherein it is wedged within the V-shaped intersection of support wall inclined segment 92*a* and finger back wall 78 to significantly increase the friction against finger the back walls 78 of fingers 72 and prevent fingers 72 from sliding relative to movable support 92 and stringer 90; thereby locking the position of all fingers 72 with respect to movable support 92 and stringer 90.

Locking mechanism 110 is an optional feature of the present invention. Marginal wall 70 could alternately be provided without a locking mechanism 110; or with a locking mechanism of different design that aims to releasably lock the position of fingers 72 relative to movable support 92. The purpose of locking mechanism 110 is to help avoid the fingers 72 from moving relative to movable support 92 once they have achieved the desired position atop form panel 40, while the castable material slurry is being poured.

It is noted that while there might remain very small gaps between the ceiling C and the top edges of fingers 72 once they are extracted and abut against the ceiling C, by providing fingers 72 that are sufficiently narrow, these small gaps will be minimized and should not allow concrete to seep due to the inherent viscosity of the concrete slurry.

Once the fingers 72 are in respective raised positions position and abut against ceiling C/C' such that the space between the top edge of form panel 40 and the ceiling is bridged; and once fingers 72 are optionally locked in this extracted or partly extracted position; then the concrete slurry is poured according to a method known in the art, between the form panel assemblies 30, 30' to fill space S up to the ceiling. The form panel assemblies 30, 30' will remain in position until the concrete has hardened. Then form panel assemblies 30, 30' may then be removed.

To remove a form panel assembly 30, the fingers 72 are first unlocked with handles 116; and then, the actuation mechanism 98 is activated to lower movable support 92. This will result in fingers 72 being lowered away from ceiling C, until they abut with their shoulders 84, 86 corresponding shoulders on form panel 40, which form panel shoulders are mostly concealed in the drawings but shown at 85 in FIG. 3. Then, bolts 100 are allowed to slide in slots 88 until they abut against the bottom of slots 88, thereby aligning all fingers 72 at a bottom, full retracted position. There might be some additional friction at this point between the now hardened concrete wall and the load-bearing surface 74*a* of front wall 74 of fingers 72, but even if that is the case and fingers 72 initially resist moving down and instead slide relative to movable support 92, an early sliding and abutment of bolts 100 on the bottom end of the slots 88 will force fingers 72 downwardly and then, movable support 92 will carry fingers 72 downward.

Once fingers 72 are in their retracted position, marginal wall 70 may be removed from form panel 40, or main remain on form panel 40, for storage and eventual future use on another worksite.

FIGS. 8-14 show another embodiment of the invention where the external surface that the fingers of the marginal wall abut is generally cylindrical, e.g. a cylindrical tunnel wall.

Figure 8:
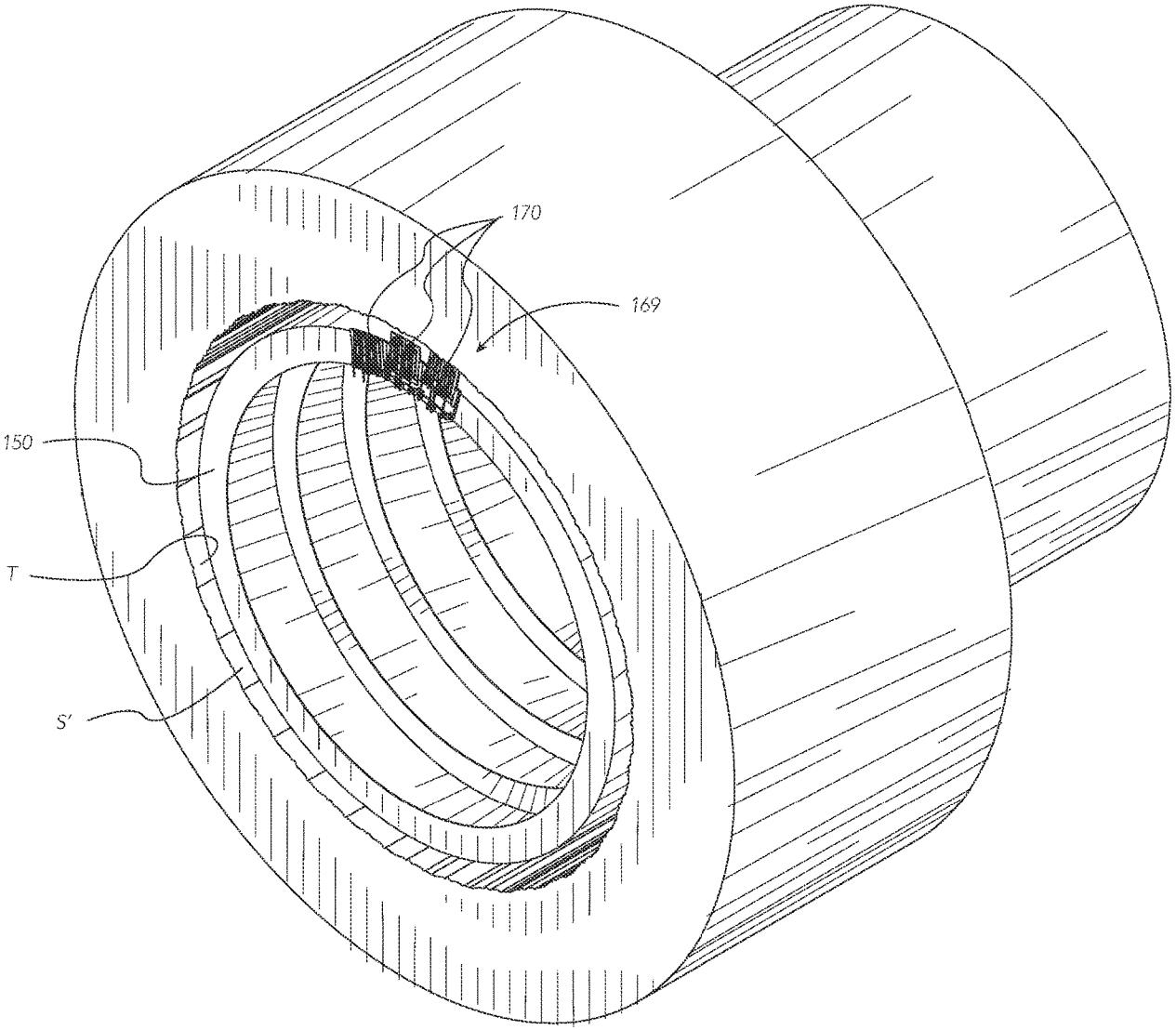
FIG. 8 is an end view of a generally cylindrical tunnel that has been excavated and within which an annular form panel assembly is installed, further showing three marginal walls forming part of a marginal wall assembly according to another embodiment of the invention.

FIG. 8 shows a conventional ring-shaped form panel assembly 150 installed within a tunnel having a generally cylindrical inner wall T. Castable material slurry is to be poured within the space S' between form panel assembly 150 and tunnel wall T to create a cylindrical castable material wall once the castable material has hardened.

FIGS. 8-14 show a marginal wall assembly 169 that in turn comprises a number of side-by-side marginal walls 170 for use on a form panel assembly 150. Although only three marginal walls 170 are shown, it is understood that a sufficient number could be used to span the entire periphery of the ring-shaped forma panel assembly 150. Each marginal wall 170 is somewhat similar to the embodiment 70 shown in FIGS. 1-7, however, marginal wall assembly 169 obviously allows the formation of a curved, e.g., ring-shaped, marginal barrier instead of a straight marginal barrier as in the embodiment of FIGS. 1-7.

Each marginal wall 170 comprises a fixed support 172 that is fixedly attached to form panel assembly 150, e.g., with bolts or by welding. A pivot mount 174 is pivotally attached to fixed support 172. A movable support 178 is slidable along the backside of fixed support 172 and is guided within a pair of rails 180, 182 provided on either side of fixed support 172 by tongues 184, 186 that protrude on either side of movable support 178. Movable support 178 is movable between a retracted position shown in FIG. 11 and on the left hand-side marginal wall 170 of FIG. 9, through an intermediate position shown on the middle marginal wall 170 of FIG. 9, and into an extracted position shown in FIG. 10 and on the right-hand side marginal wall 170 of FIG. 9. In its retracted position, the bottom portion of movable support 178 engages a space between pivot mount 174 and fixed support 172 as detailed hereinafter.

Four fingers 188 are slidable along the backside of movable support 178. Each finger 188 comprises a front wall 190 against the load-bearing surface 190*a* of which concrete slurry will accumulate and bear against while it dries. An elongated slot 192 is formed within front wall 190. An elongated first projection 193 is fixed to and extends rearwardly away from front wall 190 at a first end of front wall 190, and a shorter second projection 195 is fixed to and extends rearwardly away from front wall 190 at a second end of front wall 190.

Bolts 194 extend through a rib 196 attached on the backside of front wall 190, through slot 192 and are threaded into movable support 178. Within slots 192 are provided guide bars 197 that may slide within their respective slot 192 and that are further engaged through holes therein, by bolts 194. By sliding along guide bars 197, fingers 188 are allowed to slide relative to rib 196 and movable support 178 between a retracted position shown in FIG. 11 and on the left marginal wall 170 of FIG. 9; and an extracted position shown in FIG. 10 and in the middle and right marginal walls 170 of FIG. 9 where fingers 188 are partly or fully extracted, depending on the fingers 188. Biasing members in the form of coil springs 198 are each attached at one end to a corresponding finger 188, and more specifically to second projection 195, and at the other to rib 196. Springs 198 continuously bias fingers 188 towards their retracted position.

Marginal wall 170 comprises an actuation mechanism in the form of a crank bolt 200, the lower portion of which is fixed to pivot mount 174. Crank bolt 200 may be engaged at its lower hollow end by a manually operable crank tool (not shown) for rotating the crank bolt 200. Crank bolt 200 threadingly engages at its upper end an actuation block 202 that is fixed to the two central ribs 196 of marginal wall 170. By rotating crank bolt 200, actuation block 202 is moved along crank bolt 200, thereby carrying ribs 196 and movable support 178. Fingers 188 are normally also carried concurrently with movable support 178 when crank bolt 200 is rotated, although they are allowed to move relative to movable support 178 if sufficient force is applied against them, e.g. if they abut a tunnel wall.

Pulleys 204 will transfer part (e.g., half) of the movement imparted by actuation block 202 to movable support 178, to respective fingers 188. More particularly, each pulley includes a gear wheel 206 mounted to a corresponding rib 196. A chain 208 (or a grooved strap or other transmission member) engages gear wheel 206 and is attached to pivot mount 174 at one end and to finger front wall 192 at the other end. Coil springs 210 are attached at one end to chain 208 and at the other end to pivot mount 174. Each coil spring 210 has the following purposes:

- It maintains an appropriate tension of chain 208 on gear wheel 206 to allow the pulley 204 to work properly;
- It also acts as a compensation mechanism to allow the finger 188 to move towards pivot mount 174 relative to movable support 178 when finger 188 hits an obstacle (e.g. a tunnel wall). Coil spring 210 will then be stretched to accommodate the retraction of finger 188; and
- It acts as a tension mechanism, somewhat like the spring bolts 100/103 of the embodiment of FIGS. 1-7, to prevent fingers 188 from freely moving relative to movable support 178.

In use, when crank bolt 200 is rotated with a manually operable tool (not shown), actuation block 202 is moved along crank bolt 200, resulting in the simultaneous displacement of movable support 178 relative to fixed support 172 and of fingers 188 relative to movable support 178. It is consequently possible to extract fingers 188 beyond the outer edge of fixed support 172 and of form panel assembly 150 towards the tunnel wall T' as sequentially shown in the respective positions of the three marginal walls 170 of FIG. 9. It is understood that the simultaneous extraction of movable support 178 and of fingers 188 both contribute to moving the upper edge of the front wall 192 of fingers 188 towards tunnel wall T'.

It is possible to continue extracting fingers 188 once some fingers 188 abut against tunnel wall T' with their upper edge. Those fingers 188 abutting the tunnel wall T' will then slide relative to movable support 178 and relative to ribs 196 against the tension of coil springs 210, such that fingers 188 may adopt different positions relative to movable support 178 as shown in the right-hand side marginal wall 170 of FIG. 9, to adapt to an irregular surface of tunnel wall T'. Once all fingers 188 are at a desired position, castable material may be poured around form wall assembly 150 within space S', with the marginal wall assembly 169 preventing the concrete slurry from pouring out of the annular extremity of space S'. One ring-shaped marginal wall assembly 169 will normally be installed at each end of the form wall assembly 150.

Figure 9:
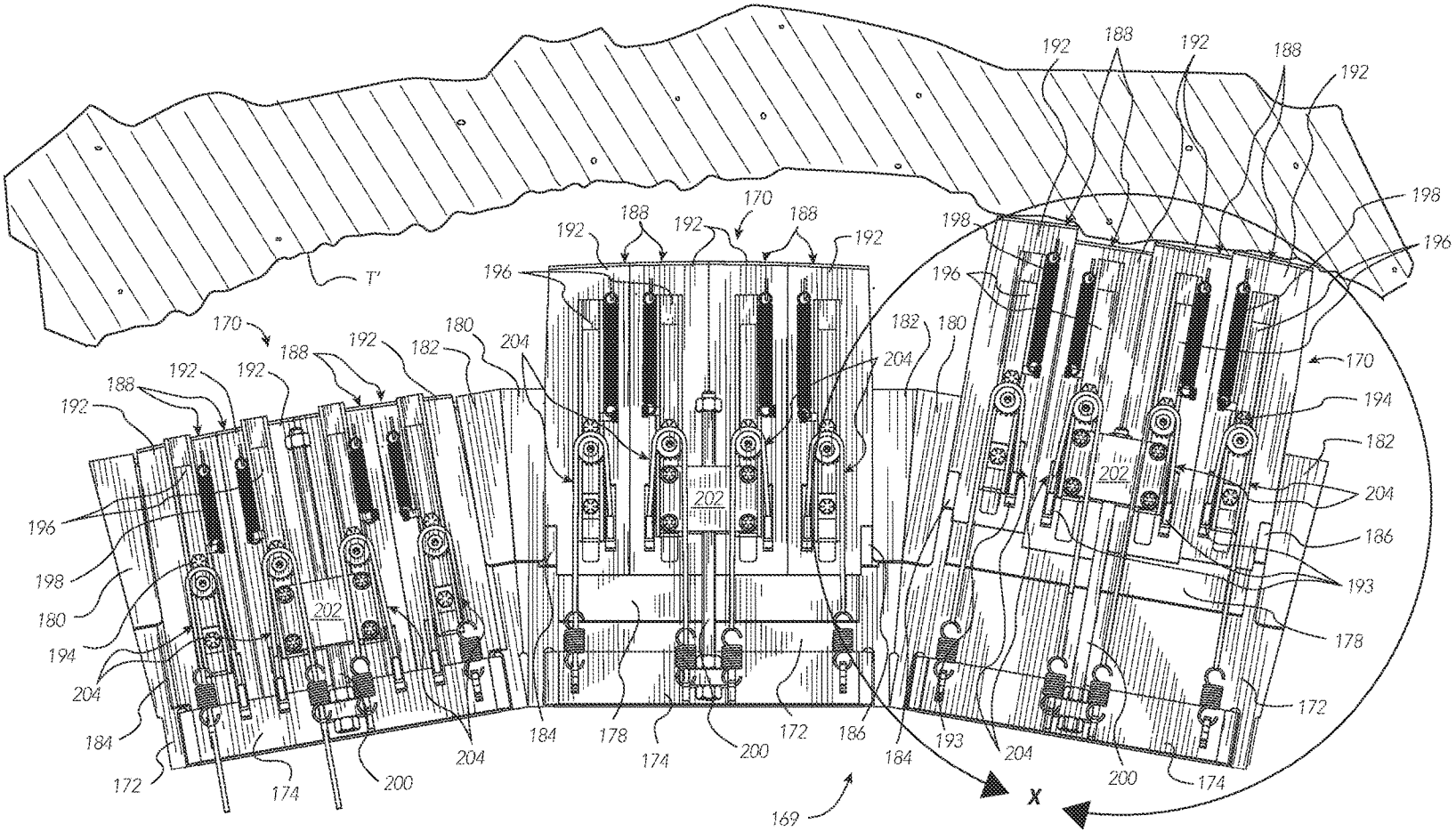
FIG. 9 is an enlarged elevation of the three marginal walls of FIG. 8, further showing the nearby portion of the tunnel wall.
Figure 10:
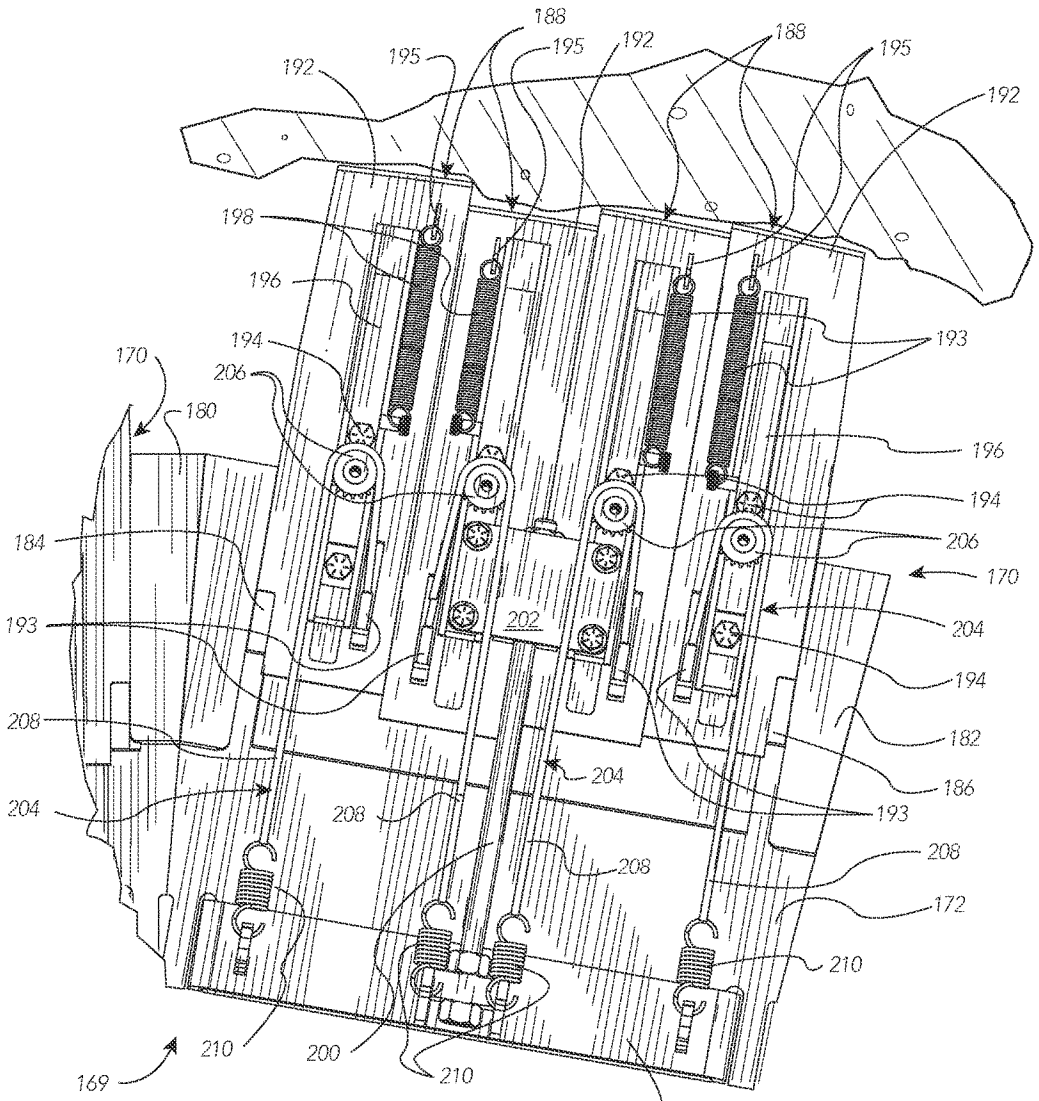
FIG. 10 is an enlarged elevation of the area circumscribed by circle X in FIG. 9.

When marginal wall 170, together with form panel assembly 150, are to be removed after concrete has been poured and has set, crank bolt 200 can be rotated in the opposite direction to retract movable support and fingers 188 towards a retracted position, shown in the left-hand side of FIG. 9.

Figure 13:
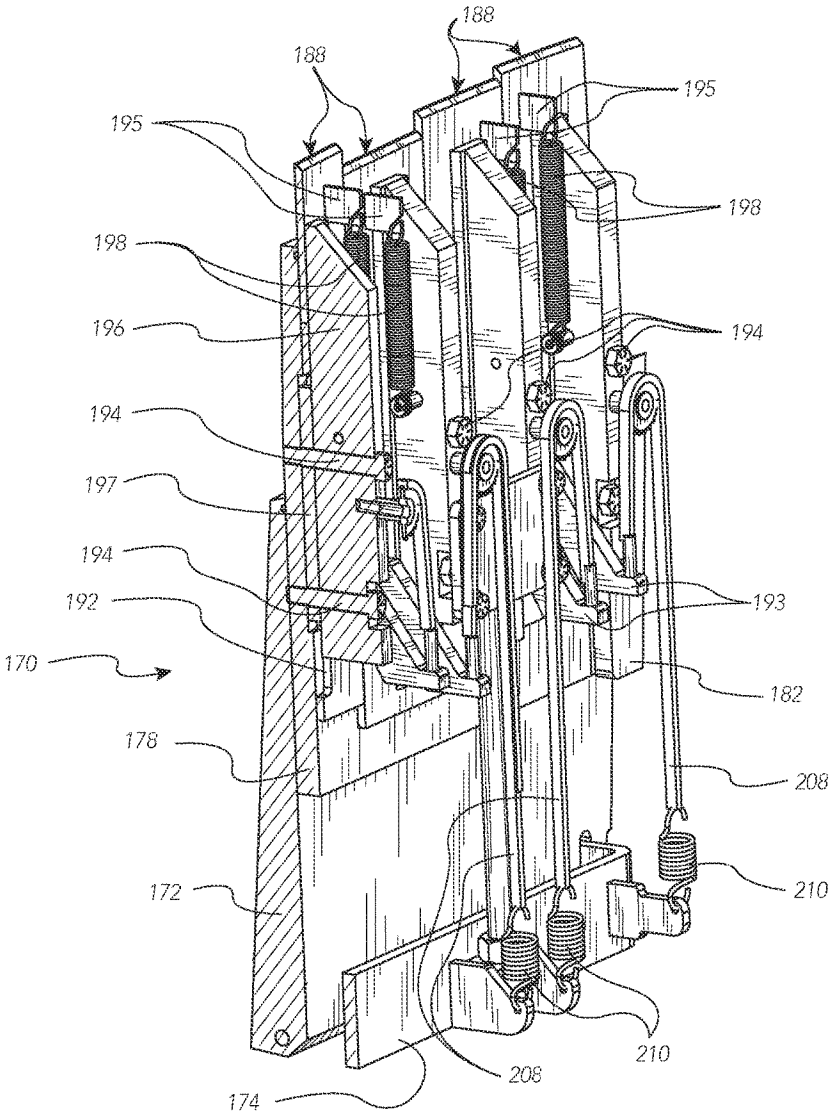
FIG. 13 is a side perspective view, partly in cross-section, of the marginal wall of FIG. 10.
Figure 14:
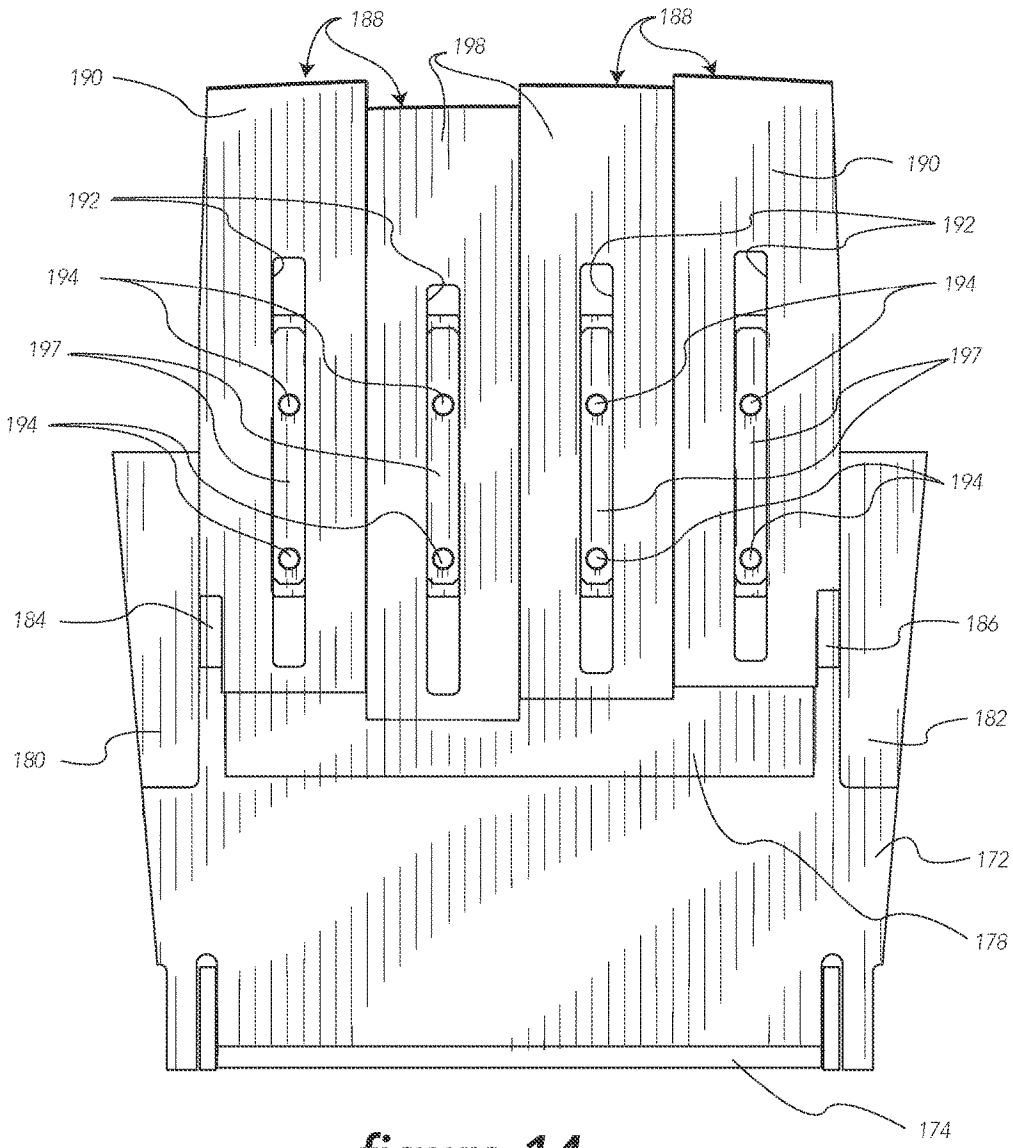
FIG. 14 is a rear elevation of the marginal wall of FIG. 10, also partly in cross-section according to a plane that is perpendicular to that of FIG. 13.

FIG. 13 shows that the interface between fixed support 172 and movable support 178 is not straight. More specifically, fixed support 172 is inclined such that movable support will move towards the target area where castable material is to be cast when fingers 188 are extracted; and will move away form the target area and from the dried wall once the castable material has been cast. The purposes of this transverse displacement of movable wall 178, and consequently of fingers 188, relative to the direction of their extraction and retraction, is to allow movable wall 178 and fingers 188 to move transversely away form the dried castable material wall when it is dried, to quickly reduce and entirely cancel all friction between, on the one hand, movable wall 178 and fingers 188, and on the other hand, the dried castable material wall.

Figure 11:
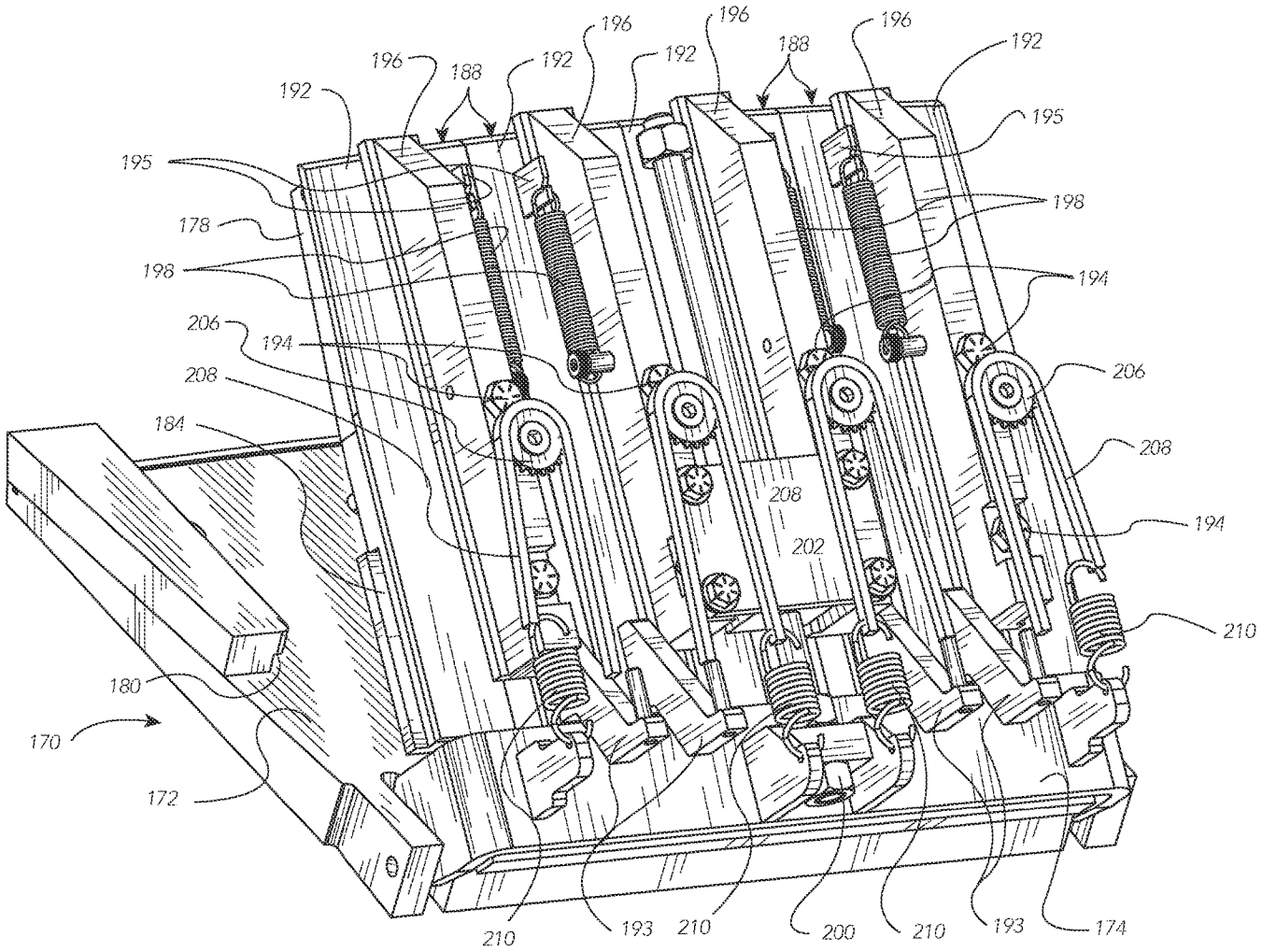
FIG. 11 is an enlarged perspective view of one of the marginal walls of FIG. 8, in an inoperative maintenance state.
Figure 12B:
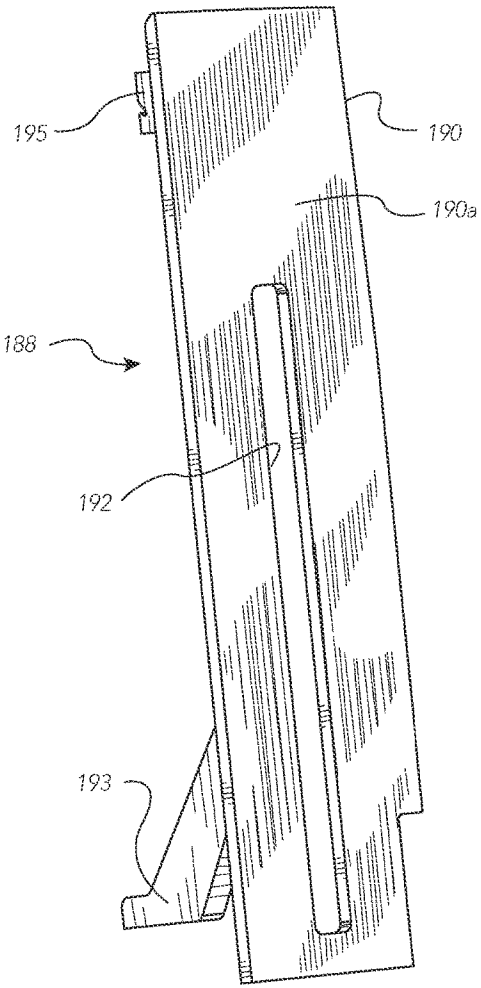
FIGS. 12A and 12B are enlarged perspective views respectively of the back and the front of one finger composing the marginal wall of FIGS. 9-11.
Figure 12A:
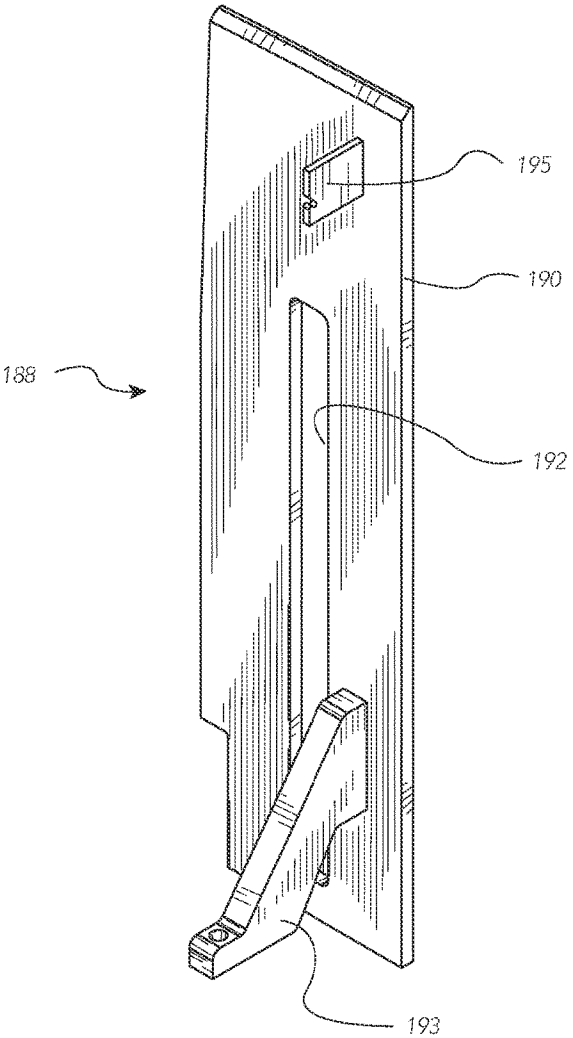

Between uses, movable support 178 may be moved down to is fully retracted position with crank bolt 200. In this position, and as shown in FIG. 11, tongues 184, 186 clear rails 180, 182 such that movable support 178 may be pivoted away from fixed support 172, guided in this movement by pivot mount 174, to allow cleaning and maintenance.

Figure 15:
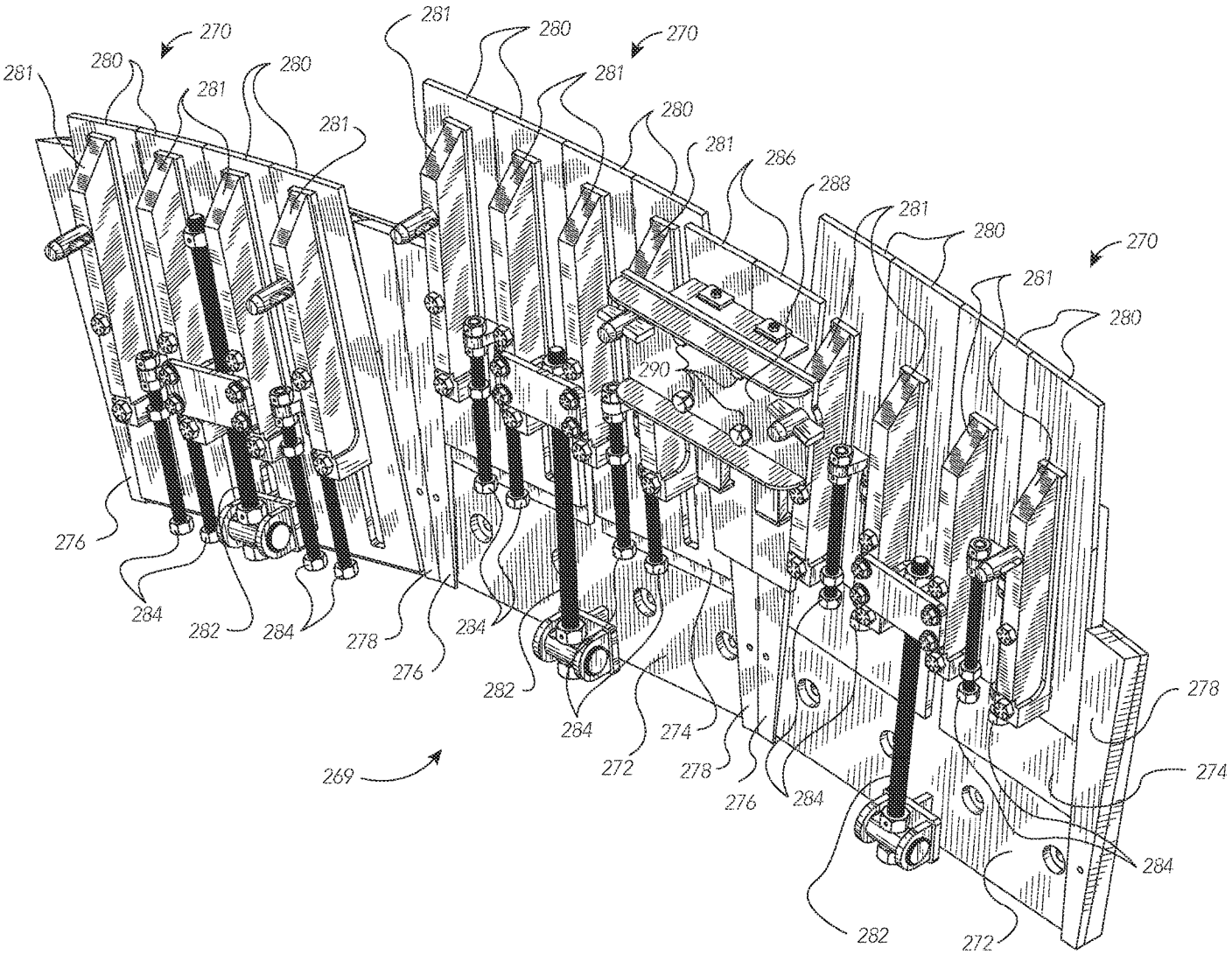
FIG. 15 is a perspective view of a portion of a marginal wall assembly comprising three marginal walls according to another embodiment of the invention.

FIG. 15 shows another embodiment of a marginal wall assembly 269 that comprises a number of marginal walls 270 that are each similar to the marginal wall 170 of the embodiment of FIGS. 8-14, except as noted below.

The general structures and function of marginal wall 270 are similar to that of marginal wall 170: Each marginal wall 270 comprises a fixed support 272 along which a movable support 274 is slidable, guided within rails 276, 278. Four fingers 280 are attached to movable support 274 with bolts that engage slots (concealed in FIG. 15) in fingers 280, ribs 281 and movable support 274 to hold fingers 280 while allowing them to slide relative to movable support 274 if sufficient force is applied against them, e.g., when fingers abut against a tunnel wall (not shown in FIG. 13). A primary crank bolt 282, operable with a manual tool, controls the displacement of movable support 274 relative to fixed support 272.

According to the embodiment of FIG. 15, the pulleys of the previous embodiment are replaced with one secondary crank bolt 284 for each finger 280. Each secondary crank bolt 284 is fixed to a corresponding rib 281 at one end and to a corresponding finger 280 at the other. By using a manually operable tool (not shown) the secondary crank bolts 284 may be rotated, which will result in the individual adjustment of the position of each finger 280 relative to movable support 274.

It is consequently possible, according to this embodiment, to make a same coarse adjustment of the position of the four fingers 280 of marginal wall 270 by moving them simultaneously relative to movable support 274 with primary crank bolt 282; and to make a fine adjustment of the position each of the four fingers 280 by moving them individually relative to movable support 274 and relative to each other with secondary crank bolts 284.

A pair of additional intermediate fingers 286 is provided on marginal wall assembly 269 between each two adjacent marginal walls 270. Intermediate fingers 286 are carried by an intermediate finger support 288 that is fixed to a rib 281 of each of the two adjacent marginal walls 270. The bolts 290 that fix intermediate fingers 286 to intermediate finger support 288 may be loosened to adjust the position of intermediate fingers 286 relative to intermediate finger support 288; and then tightened once the desired position is achieved. Intermediate fingers allow to retain concrete slurry to flow between marginal walls 270. Intermediate fingers 286 could also be used in the embodiment of FIGS. 8-11 and 12A, 12B.

Figure 16:
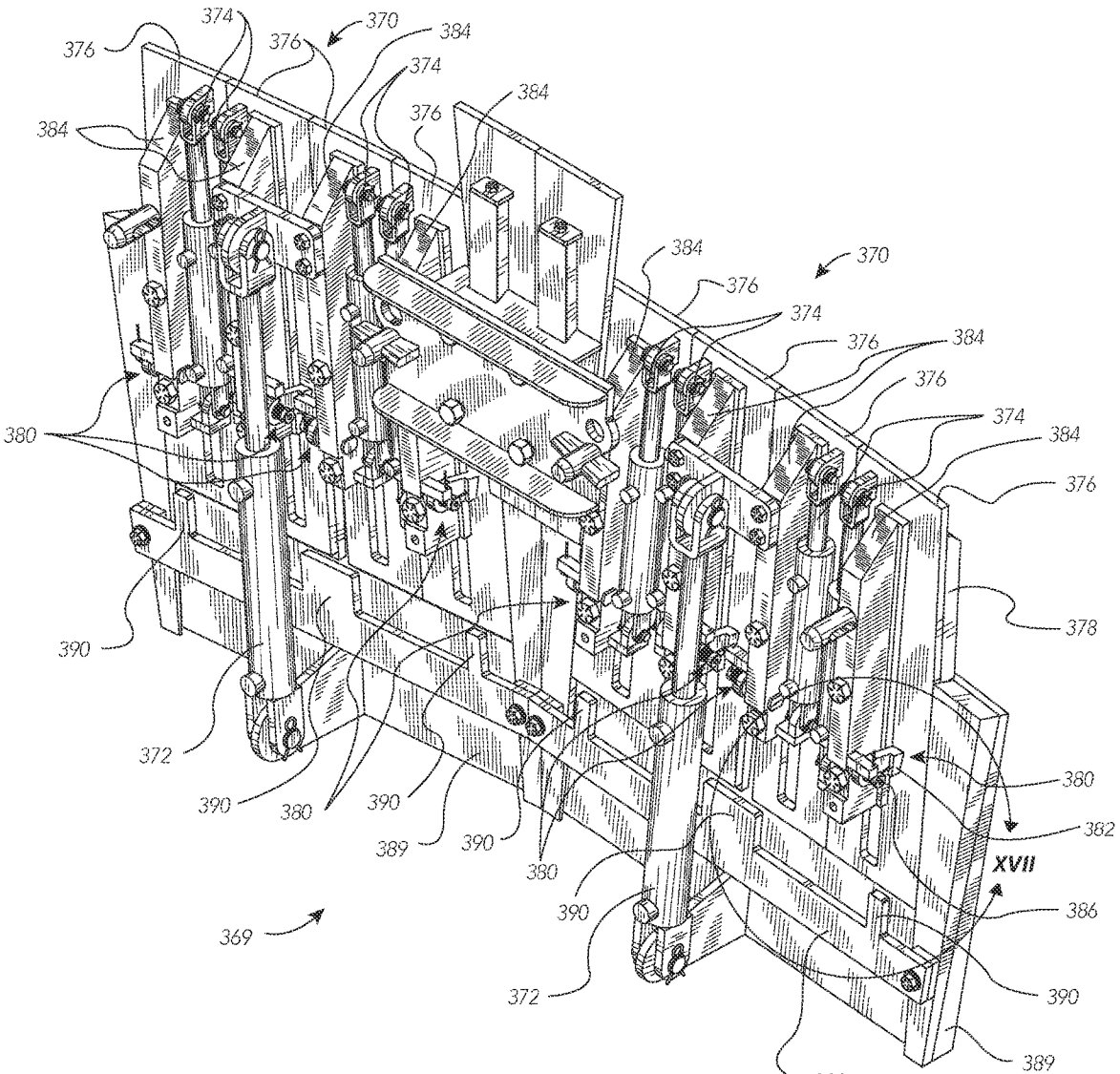
FIG. 16 is a perspective view of a portion of a marginal wall assembly comprising three marginal walls according to yet another embodiment of the invention.
Figure 17:
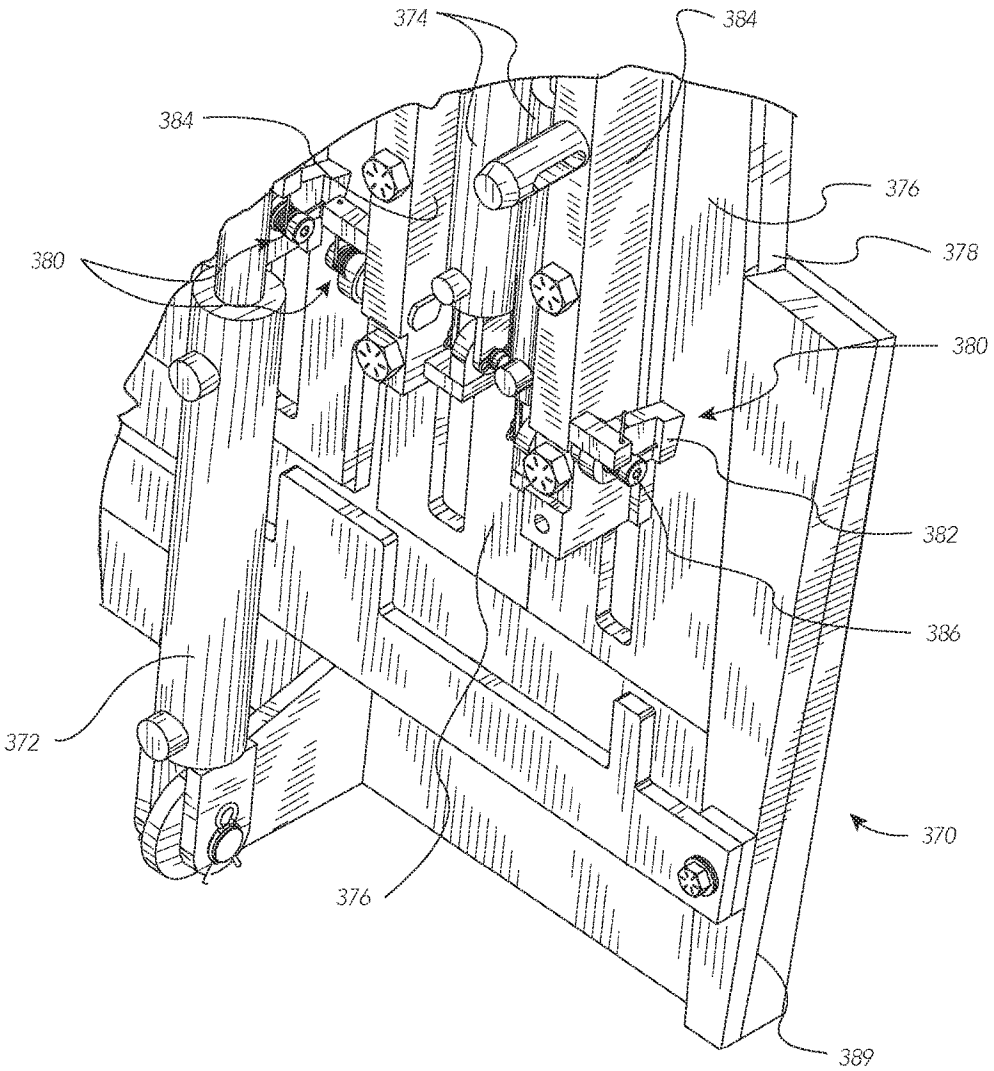
FIG. 17 is an enlarged perspective view of the area circumscribed by circle XV in FIG. 14.

FIGS. 16 and 17 show another embodiment of a marginal wall assembly 369 that comprises a number of marginal walls 370 that are similar to the marginal wall 270 of the embodiment of FIG. 15, except as noted below.

In the embodiment of FIGS. 16 and 17, a fixed support 389 carries a movable support 378, with fingers 376 being in turn being slidably carried on movable support 378, like in the other embodiments. The primary crank bolts and the secondary crank bolts of the embodiment of FIG. 15 are replaced respectively with primary hydraulic cylinders 372 that allow a coarse adjustment of the position of the four fingers 376 of marginal wall 370 by moving movable support 378 that carry fingers 376; and secondary hydraulic cylinders 374 that allow to make a fine individual adjustment of the position each of the four fingers 376 by moving them individually relative to movable support 378 and relative to each other.

In the embodiment of FIGS. 16 and 17 there is further shown a mechanical braking mechanism used to prevent fingers 376 from moving downwardly relative to movable support 378 unless movable support 378 is retracted beyond a determined position.

More particularly, the braking mechanism comprises a number of brake members 380 that each in turn comprise a friction brake lever 382 that is pivotally attached to a respective rib 384 so as to be pivotable between a braking position in which it engages a corresponding finger 376 to prevent it from being retracted, i.e. from moving downwardly relative to movable support 378, and a released position in which it is pivoted away from its corresponding finger 376 to allow its corresponding finger 376 to be retracted and to slide downwardly relative to movable support 378. A torsion spring 386 continuously biases friction brake lever 382 towards its braking position. A brake plate 388 is attached to fixed support 389. Brake plate 388 has brake tabs 390 that protrude towards fingers 376.

In use, brake lever 382 is biased into its braking position by torsion spring 386 while finger 376 is being extracted. Due to the angle of the brake lever 382 that abuts against fingers 376, brake lever 382 will slide against finger 376 while it is being extracted such that brake lever 382 will not prevent or hinder the extraction of finger 376 relative to movable wall 378 under the action of secondary hydraulic cylinders 374. However, brake lever 382 will act to prevent the undesired retraction of finger 376 during their extraction process, unless sufficient force is applied against finger 376, e.g. if finger 376 abuts against a tunnel wall. If such an abutment applies sufficient force to counter the friction force of lever 382, finger 376 is allowed to move downwardly relative to movable support 378. Once the wall of castable material has dried and the marginal walls 370 and form panels are to be removed, movable wall 378 may be retracted with primary cylinder 372. Fingers 376 will initially be prevented from moving downwardly relative to movable wall 378, until fingers 376 are lowered to the point where brake tabs 390 engage friction brake levers 382 to force them towards their released position, against the bias of torsion springs 386, effectively then allowing fingers 376 to move downwardly under the action of secondary hydraulic cylinders 374.

It can consequently be understood from the above embodiments, that the invention further relates to a method of casting castable material in a target area comprising the steps of:

- providing a form panel. This form panel may be of any suitable shape and size, e.g. rectangular, or forming a ring;
- providing a marginal wall comprising a fixed support, a number of fingers movably carried by the fixed support, and an actuation mechanism capable of moving the fingers relative to the fixed support. The marginal wall will have a shape, size and configuration to match or adapt to the form panel;
- attaching the fixed support of the marginal wall to the form panel. This attachment may be accomplished in any way that would be obvious to a person skilled in the art;
- placing the form panel at a limit position of the target area where the castable material is to be cast, with the form panel having an edge positioned near an external surface. The external surface may be, e.g., a tunnel wall, a tunnel ceiling, or any other obstacle;
- moving, with the actuation mechanism, at least some of the fingers beyond and away from the edge of the form panel to form a marginal barrier between the edge of the form panel and the external surface, with at least some of the fingers being moved distinctly from the others such that the marginal barrier will be of variable dimensions; and
- pouring castable material slurry in the target area and retaining the castable material slurry in the target area with the form panel and with a load-bearing surface of the fingers of the marginal wall, with the fingers of the marginal wall preventing the castable material slurry from flowing between the edge of the form panel and the external surface.

More particularly, the fingers are slidably attached to a movable support that is movably carried by the fixed support, with the step of moving at least some of the fingers beyond and away from the edge of the form panel comprising:

- moving the movable support relative to the fixed support with the actuation mechanism; and
- allowing at least some fingers to abut the external surface wherein a sufficient force is applied upon the fingers to overcome a resistance threshold to move the fingers distinctly with respect to each other and with respect to the movable support.

While certain representative embodiments and details have been shown for purposes of illustrating the invention, it will be apparent to those skilled in the art that various changes may be made without departing from the scope of the disclosure, which is further described in the following appended claims.

What is claimed is:

1. A combination of a form panel and a marginal wall for use in casting castable material, the form panel having an edge to be positioned near an external surface, the marginal wall comprising a fixed support for attachment to the form panel, a number of fingers movably carried by the fixed support so as to be movable relative to the edge of the form panel between an extracted and a retracted position, with the fingers extending beyond the edge of the form panel edge at least in their extracted position, the fingers having a load-bearing surface for retaining castable material slurry, and an actuation mechanism capable of moving the fingers between the retracted and extracted positions, wherein the fingers are movably carried by the fixed support such that at least some of the fingers are distinctly movable with respect to the others for forming a marginal barrier of variable size between the edge of the form panel and the external surface when the fingers are moved towards or into their extracted position.

2. The combination of claim 1, wherein the fingers are slidably attached to a movable support that is movably carried by the fixed support, with the actuation mechanism moving the movable support relative to the fixed support, and with the fingers being carried by the movable support so as to allow the fingers to move concurrently with the movable support under the action of the actuation mechanism, and with the fingers additionally being slidable relative to the movable support if sufficient force is applied upon the fingers to overcome a resistance threshold for allowing the fingers to move distinctly with respect to each other and with respect to the movable support when at least some fingers abut the external surface.

3. The combination of claim 1, wherein the edge of the form panel is straight and the fingers are disposed parallel to each other.

4. The combination of claim 1, wherein the edge of the form panel is curved and the fingers are each disposed generally perpendicularly to the curved edge in a divergent configuration.

5. The combination of claim 2, further comprising a locking mechanism for releasably locking the fingers relative to the movable support in the extracted or retracted position.

6. The combination of claim 2, wherein the actuation mechanism comprises selectively powered hydraulic cylinders attached to the fixed support and to the movable support.

7. The combination of claim 2, wherein the actuation mechanism comprises at least one manually operable crank bolt attached to the fixed support and to the movable support.

8. The combination of claim 7, wherein the actuation mechanism comprises additional fine displacement members to move the fingers relative to the movable support.

9. The combination of claim 2, wherein when the form panel defines a load-bearing surface that is generally parallel to the load-bearing surface of the fingers, and when the fingers are moved from their extracted towards their retracted position, they also move transversely in a direction that is away from the form panel load-bearing surface.

10. A marginal wall for use with a form panel used for casting castable material, comprising:

a fixed support for attachment to the form panel;

a number of fingers movably carried by the fixed support so as to be movable relative to the fixed support between an extracted and a retracted position, with the fingers for extending beyond an edge of the form panel edge at least in their extracted position, and with the fingers having a load-bearing surface for retaining castable material slurry;

an actuation mechanism capable of moving the fingers between the retracted and extracted positions;

wherein the fingers are movably carried by the fixed support such that at least some of the fingers are distinctly movable with respect to the others, for forming with the fingers a marginal barrier of variable size beyond the edge of the form panel.

11. The marginal wall of claim 10, wherein the fingers are slidably attached to a movable support that is movably carried by the fixed support, with the actuation mechanism moving the movable support relative to the fixed support, and with the fingers being carried by the movable support so as to allow the fingers to move concurrently with the movable support under the action of the actuation mechanism, and with the fingers additionally being movable relative to the movable support if sufficient force is applied upon the fingers to overcome a resistance threshold for allowing the fingers to move distinctly with respect to each other and with respect to the movable support when at least some fingers abut an external surface.

12. The marginal wall of claim 10, wherein the fingers are disposed parallel to each other for use with a form panel having a straight edge.

13. The marginal wall of claim 10, wherein the fingers are disposed in a generally divergent configuration for use with a form panel having a curved edge.

14. The marginal wall of claim 11, further comprising a locking mechanism for releasably locking the fingers relative to the movable support in the extracted or retracted position.

15. The marginal wall of claim 11, wherein the actuation mechanism comprises selectively powered hydraulic cylinders attached to the fixed support and to the movable support.

16. The marginal wall of claim 11, wherein the actuation mechanism comprises at least one manually operable crank bolt attached to the fixed support and to the movable support.

17. The marginal wall of claim 16, wherein the actuation mechanism comprises additional fine displacement members to move the fingers relative to the movable support.

18. A method of casting castable material in a target area comprising the steps of:

providing a form panel;

providing a marginal wall comprising a fixed support, a number of fingers movably carried by the fixed support, and an actuation mechanism capable of moving the fingers relative to the fixed support;

attaching the fixed support of the marginal wall to the form panel;

placing the form panel at a limit position of a target area where a castable material slurry is to be cast, with the form panel having an edge positioned near an external surface;

moving, with the actuation mechanism, at least some of the fingers beyond and away from the edge of the form panel to form a marginal barrier between the edge of the form panel and the external surface, with at least some of the fingers being moved distinctly from the others such that the marginal barrier will be of variable dimensions; and pouring the castable material slurry in the target area and retaining the castable material slurry in the target area with the form panel and with a load-bearing surface of the fingers of the marginal wall, with the fingers of the marginal wall preventing the castable material slurry from flowing between the edge of the form panel and the external surface.

19. The method of claim 18, wherein the fingers are slidably attached to a movable support that is movably carried by the fixed support, with the step of moving at least some of the fingers beyond and away from the edge of the form panel comprising:

moving the movable support relative to the fixed support with the actuation mechanism; and allowing at least some of the fingers to abut the external surface when a sufficient force is applied upon the fingers to overcome a resistance threshold to move the fingers distinctly with respect to each other and with respect to the movable support.

20. The method of claim 19, wherein in the step of moving at least some of the fingers beyond and away from the edge of the form panel, the fingers are moved parallel to each other, such that the marginal barrier formed by the fingers is generally straight.

21. The method of claim 19, wherein in the step of moving at least some of the fingers beyond and away from the edge of the form panel, the fingers are moved in a divergent configuration, such that the marginal barrier formed by the fingers is generally curved.

* * * * *